US010077492B2

(12) United States Patent
Li et al.

(10) Patent No.: US 10,077,492 B2
(45) Date of Patent: Sep. 18, 2018

(54) ULTRAFINE-GRAINED PROFILE OF TWIN-CRYSTAL WROUGHT MAGNESIUM ALLOYS, PREPARATION PROCESS AND USE OF THE SAME

(71) Applicant: Jiangyin Biodegrade Medical Technology Co., Ltd, Jiangyin (CN)

(72) Inventors: Li Li, Jiangyin (CN); Yufeng Zheng, Jiangyin (CN); Zhen Li, Jiangyin (CN); Qingfu Chen, Jiangyin (CN); Diantao Zhang, Jiangyin (CN); Jingtao Li, Jiangyin (CN)

(73) Assignee: Jiangyin Biodegrade Medical Technology Co., Ltd., Jiangsu (CN)

( * ) Notice: Subject to any disclaimer, the term of this patent is extended or adjusted under 35 U.S.C. 154(b) by 538 days.

(21) Appl. No.: 14/624,372

(22) Filed: Feb. 17, 2015

(65) Prior Publication Data

US 2016/0168678 A1 Jun. 16, 2016

(30) Foreign Application Priority Data

Dec. 11, 2014 (CN) ..... 2014 1 0766055

(51) Int. Cl.

| | |
|---|---|
| ***C22F 1/06*** | (2006.01) |
| ***C22C 23/00*** | (2006.01) |
| ***C22C 23/02*** | (2006.01) |
| ***C22C 23/04*** | (2006.01) |
| ***C22C 23/06*** | (2006.01) |

(52) U.S. Cl.

CPC ..... *C22F 1/06* (2013.01); *C22C 23/00* (2013.01); *C22C 23/02* (2013.01); *C22C 23/04* (2013.01); *C22C 23/06* (2013.01)

(58) Field of Classification Search

CPC ..... C22F 1/06
USPC ..... 148/557, 667
See application file for complete search history.

(56) References Cited

FOREIGN PATENT DOCUMENTS

| | | |
|---|---|---|
| CN | 102304653 A | 1/2012 |
| CN | 102433477 A | 5/2012 |
| CN | 103243283 A | 8/2013 |

OTHER PUBLICATIONS

First Office Action and Search Report for Chinese Application No. 201410766055.3, dated Feb. 23, 2016.

(Continued)

*Primary Examiner* — Brian Walck
(74) *Attorney, Agent, or Firm* — Patterson + Sheridan, LLP

(57) ABSTRACT

The present invention provides an ultrafine-grained profile of twin-crystal wrought magnesium alloys, preparation process and use of the same. In the process, raw materials of magnesium alloys are firstly smelted and cast, and are subjected to solution treatment at 300~500° C.; then a preform is pre-deformed, so that a great amount of twin crystal microstructure forms in the magnesium alloys and the grain size of not larger than 100 μm is achieved; subsequently continuous ECAP process is performed at 200~350° C., and the die is replaced in according to requirement so as to obtain the desired profile. The ultrafine-grained profile of magnesium alloys prepared in the invention has the grain sizes of from 100 to 450 nm, the tensile strength of 300~400 MPa, and the elongation of 20~35%. The length of the profile can be more than 10 m, meeting the needs of continuous production.

10 Claims, 2 Drawing Sheets

(56) References Cited

OTHER PUBLICATIONS

Zhang Jing, Pan Fu-sheng, Peng Jian, Ding Pei-dao, Wang Ling-yun, "Alloy Systems and Compounds in Magnesium Alloys," Proceedings of the first International Conference on smelting and processing light metals & Equipment in China, Apr. 25, 2002, pp. 294-307.

First Office Action and Search Report for Chinese Application No. 201410766055.3, dated Feb. 23, 2016 and Abstracts, 14 pages.

ULTRAFINE-GRAINED PROFILE OF TWIN-CRYSTAL WROUGHT MAGNESIUM ALLOYS, PREPARATION PROCESS AND USE OF THE SAME

CROSS REFERENCE TO RELATED APPLICATIONS

This application claims the priority benefit of Chinese Patent Application No. Chinese Patent Application No. 201410766055.3, filed on Dec. 11, 2014, which is hereby incorporated by reference in its entirety.

TECHNICAL FIELD

The present invention belongs to the field of metal material preparation and processing. In particular, the present invention relates to an ultrafine-grained profile of magnesium alloys, especially to an ultrafine-grained profile of twin-crystal wrought magnesium alloys, preparation process and use of the same.

BACKGROUND TECHNOLOGY

There is a growing interest in using magnesium and magnesium alloys in a number of medical devices (such as sheet, rod, tube, nails, bone plate and endovascular stent, etc.), because of magnesium and magnesium alloy have low density, light weight, high strength, good biological compatibility and biodegradable properties etc. Therefore, magnesium alloys have great advantages and potential in the field of orthopedic instruments, interventional medical devices and dental care. Magnesium alloys with high specific strength, high specific stiffness, good machinability, and good damping ability are widely used in the field of automotive, aerospace, electronics and so on.

Magnesium alloys have a hexagonal close-packed structure and less slip system at low temperature, and are brittle, so there are significant limits in its application. Grain refinement is an effective method to improve the comprehensive performance of magnesium alloy. Not only the strength of magnesium alloy increases, but also can improve the plasticity by grain refinement. At present, there are several methods for grain refinement (such as powder metallurgy, rapid solidification, severe plastic deformation (SPD), etc.). The ultrafine-grained materials of larger size can be prepared by SPD, and SPD has no impurity or defect introduction like the other methods (such as powder metallurgy, spray deposition and rapid solidification, amorphous crystallization, etc.). Researchers focused more on Equal Channel Angular Pressing (ECAP) method which is one kind of SPD methods.

At present, ECAP has been used to process magnesium alloys to refine grains. In Application number CN201310355624.0 entitled "EXTRUSION DIE AND EXTRUSION METHOD OF RARE EARTH MAGNESIUM ALLOY", Application number CN200910099591.1 entitled "METHODS AND BACK PRESSURE RECIPROCATING DIES TUNNEL OF MAGNESIUM ALLOY", Application number CN200910071255.6 entitled "ROTATR EXTRUSION DIE AND METHOD OF MAGNESIUM ALLOY SQUARE BAR", Application number CN200810233106.0 entitled "METHOD AND DIE OF CONTINUOUS ANGLE SHEAR MAGNESIUM ALLOY", the ECAP dies were designed and used in pressing magnesium alloys.

Application number CN201310149560.9 entitled "METHOD FOR NANO-CRYSTALLINE MAGNESIUM ALLOY PREPARATION BY CONTINUOUS SEVERE PLASTIC DEFORMATION" discloses a method for manufacturing homogeneous magnesium alloys with the average grain size of below 100 nm by high pressure torsion after ECAP.

Application number CN201210516981.6 entitled "METHOD FOR HIGH YIELD OF ULTRAFINE CRYSTAL MAGNESIUM ALLOY SHEET PROCESSING" discloses a method for manufacturing a magnesium alloy sheet and a magnesium alloy wide plate by rolling after ECAP.

Application number KR20030060830 entitled "FORMING METHOD CAPABLE OF MINIMIZING GRAIN SIZE OF MAGNESIUM ALLOY BY IMPROVING MICROSTRUCTURE OF MAGNESIUM ALLOY THROUGH PLASTIC DEFORMATION OF MAGNESIUM ALLOY USING ECAP (EQUAL CHANNEL ANGULAR PROCESS" discloses a method for maximizing grain refinement of magnesium alloy when an ECAP is applied to magnesium alloy to increase ductility of magnesium, maintain a certain yield strength or more and expect to improve high temperature super plasticity according to grain refinement.

Application number KR20050024737 entitled "METHOD FOR MANUFACTURING HIGH STRENGTH/HIGH DUCTILITY MAGNESIUM ALLOY WITHOUT CHANGE OF MAGNESIUM ALLOY CONSTITUENTS BY CONTROLLING TEXTURE OF MAGNESIUMALLOY" discloses a method for manufacturing a magnesium alloy having strength that is far higher than that of an existing magnesium by controlling texture of the magnesium alloy by ECAP, and a method for manufacturing a magnesium alloy having strength similar to that of the existing magnesium and improved ductility by increasing ductility and minimizing yield strength reduced when using the ECAP.

Application number KR20050024735 entitled "METHOD FOR IMPROVING WORKABILITY OF MAGNESIUM AT ORDINARY TEMPERATURE BY DEVELOPING TEXTURE OF MAGNESIUM" discloses a magnesium alloy ECAP method for manufacturing magnesium alloy excellent in ductility by developing texture in magnesium.

The hydraulic equipments are used for ECAP in these above patents or applications, and their disadvantages are as follow: 1. The length of ultrafine-grained magnesium alloy prepared using hydraulic equipment is limited. The length of original preforms should be less than 100 mm due to the sizes of die and plunger. The final product does not exceed 80 mm because of the incomplete deformation areas; 2. In order to obtain the significant grain refinement of magnesium alloys, more than 8 passes of the ECAP have to be used. Accordingly, their production cost is high, and the production efficiency is low; 3. During ECAP process, once the pressing of one pass fails, the whole preform cannot continue to be used. And the incomplete deformation area accounts for about 20%, so the rejection rate is more than 1/4. 4. The prepared materials are preforms, and secondary processing is necessary.

In summary, the method with high production efficiency, low rejection rate, no upper size limit, and continuous production needs to be urgently exploited.

SUMMARY OF THE INVENTION

One of the objects of the present invention is to provide a continuous process for industrially preparing ultrafine-grained profile of twin-crystal wrought magnesium alloys, which comprises the steps as follows:

(1) subjecting raw materials of magnesium alloys to smelting and casting under the atmospheric protection, and solution treatment at 300~500° C.;

(2) subjecting a preform obtained from step (1) to pre-deformation, so that a great amount of twin crystal microstructure forms in the magnesium alloys and the grain size of not larger than 100 μm can be achieved;

(3) conducting continuous ECAP (Equal Channel Angular Pressing) process below the re-crystallization temperature, wherein the channel angle is 90°~120°, the linear pressing speed is not beyond 10 mm/s, the strain rate in the last pass is about 60~340%, and the die can be replaced in the last pass of the pressing according to requirement so as to obtain the desired profile; and (4) annealing the profile at 150~300.

In one embodiment, said magnesium alloys are selected from the group of consisting of Mg-RE, Mg—Th, Mg—Li, Mg-RE-Zr, Mg—Al—Mn, Mg—Al—Zn, Mg—Zn—Zr, Mg—Sn—Mn and Mg—Sn—Zn—Mn.

In another embodiment, the pre-deformation in step (2) of the process includes extrusion, drawing, rolling, or solid solution and reageing treatment. Magnesium alloys after pre-deformation can be used without straightening and surface treatment.

The object of the present invention is further to provide ultrafine-grained profile of twin-crystal wrought magnesium alloys obtained by the above process. In one embodiment, the grain sizes of the ultrafine-grained profile can be from 100 to 450 nm.

In another embodiment, the tensile strength of the ultrafine-grained profile can reach 300~400 MPa, and its elongation can be 20~35%.

The object of the present invention is also to provide use of the above ultrafine-grained profile of twin-crystal wrought magnesium alloys in making the medical treatment apparatuses of type I, II and III, such as biodegradable cardiovascular stents and stents for neighbouring areas, vascular clamp, anastomat, sutures, bone plate and bone nail, implanted devices for surgical repairing, tissue engineering scaffolds and so on.

DETAILED DESCRIPTION

Figure 1A:
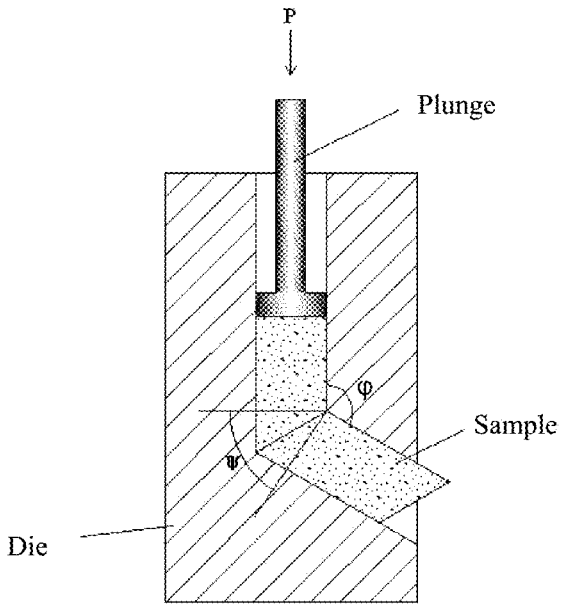
FIG. 1A is a schematic view showing the principle of ECAP technique.

As mentioned above, in preparation of the magnesium alloy profiles by means of traditional ECAP, there are many technical disadvantages, such as limited length, long production cycle, high rejection rate, secondary processing and so on. In view of this, the inventors have utilized continuous ECAP technique to press wrought magnesium alloys firstly, thereby achieving ultrafine graining of magnesium alloys.

Specifically, the present invention provides a process for preparing ultrafine-grained profile of twin-crystal wrought magnesium alloys, comprising: (1) subjecting raw materials of magnesium alloys to smelting and casting under the atmospheric protection, and solid solution treatment at 300~500° C.; (2) subjecting a preform obtained from step (1) to pre-deformation, so that a great amount of twin microstructure forms in the magnesium alloys and the grain size of below 100 μm can be achieved; (3) conducting continuous ECAP process on the magnesium alloy from step (2) below the re-crystallization temperature, wherein the channel angle is 90°~120°, the linear pressing speed is not beyond 10 mm/s, the strain rate in the last pass is about 60~340%, and the die can be replaced in the last pass of the pressing according to requirement so as to obtain the desired profile; and (4) annealing the profile at 150~300° C.

In order to achieve the best processing performance and comprehensive mechanical properties, magnesium alloys used in the present invention are mainly selected from the group consisting of Mg-RE, Mg—Th, Mg—Li, Mg-RE-Zr, Mg—Al—Mn, Mg—Al—Zn, Mg—Zn—Zr, Mg—Sn—Mn and Mg—Sn—Zn—Mn. The RE of Mg-RE alloy can be one or more of Nd, Y, Gd, and totally 3.0~9.0 weight-percent in content, and the rest is Mg and unavoidable impurities. Th in Mg—Th alloy can be 0.10~4.0 weight-percent in content, and the rest is Mg and unavoidable impurities. Li in Mg—Li alloy can be 0.10~5.0 weight-percent, and the rest is Mg and unavoidable impurities. RE in Mg—RE-Zr alloy can be one or more of Nd, Y, Gd, and totally 3.0~9.0 weight-percent in content, Zr can be 0.2~3.5 weight-percent in content, and the rest is Mg and unavoidable impurities. Al in Mg—Al—Mn alloy can be 1.0~6.5 weight-percent in content, Mn can be 0.10~1.0 weight-percent in content, the content of Zn is 0.10~0.40 weight-percent, and the rest is Mg and unavoidable impurities. Al in Mg—Al—Zn alloy can be 1.0~6.5 weight-percent in content, Zn can be 0.10~6.5 weight-percent in content, the content of Mn is 0.10~1.0 weight-percent, and the rest is Mg and unavoidable impurities. Zn in Mg—Zn—Zr alloy can be 0.1~6.5 weight-percent in content, Zr can be 0.20~3.5 weight-percent, and the rest is Mg and unavoidable impurities. Sn in Mg—Sn—Mn alloy can be 1.0~10 weight-percent in content, Mn can be 0.10~1.0 weight-percent, and the rest is Mg and unavoidable impurities. Sn in Mg—Sn—Zn-Mn alloy can be 1.0~10 weight-percent in content, Zn can be 0.50~10 weight-percent, Mn can be 0.10~1.0 weight-percent, and the rest is Mg and unavoidable impurities.

In order to obtain magnesium alloy of high purity and well performance, smelting and casting are conducted under the atmospheric protection. The used atmosphere can be selected by one skilled in the art, depending on the actual alloy system. For example, $SF_6$+$CO_2$ gas can be used to prevent formation of oxide.

For the convenience of subsequent processing, preforms of different shapes can be obtained by controlling shapes of casting dies. For example, if the pre-deformation proceeds by rolling, the square preform is generally used; if by extrusion or drawing, the cylindrical preform is generally used.

In order to make alloy elements fully diffuse within the magnesium matrix and achieve homogenization, the smelted and cast magnesium alloys need to be subjected to solid solution treatment. The solution treatment can last 20~30 hrs at 300~500° C.

Magnesium alloys have a hexagonal close-packed structure and less slip system, and are brittle, so there are significant limits in its application. In view of this, according to the Hall-Petch principle, the present inventors have succeeded in increasing slip system and improving deformation, thereby refining grain by severe plastic deformation to increase its strength and toughness.

To be specific, the present inventors have pre-deformed magnesium alloys before continuous ECAP, so that a great amount of twin crystal microstructure forms in the magnesium alloys, thereby increasing slip deformation of the magnesium alloys. Herein, "a great amount of" can be measured by means of volume percent of the produced twin crystal, and if the twin crystal is beyond 30% by volume, it can be construed to obtain a great amount of twin crystal. The present inventors propose two types of pre-deformation: (1) magnesium alloys produce wrought twin crystal by plastic deformation. Under the action of tangential stress, part of the crystal evenly shears along a certain crystal plan (twinning plan) and a certain direction (twinning direction). After twinning deformation, deformed part and undeformed part in the crystal constitute mirror symmetry, which changes the corresponding orientation of the crystal on both sides of the mirror and is beneficial to continuation of slip deformation. (2) Magnesium alloys produce transformation twin crystals by solid solution and reageing treatment. During the solid solution treatment, alloys of intermediate phase dissolve and the alloy elements (such as Al) may be incorporated into the magnesium alloy matrix in the form of substituting solid-solution atoms. Distribution of internal stress changes within the magnesium alloys and sub-grain structure is formed. The sub-grain structure disappears and energy releases during reageing treatment, which is beneficial to formation of twin crystals. "Solid solution and reageing treatment" herein means holding magnesium alloys subjected to solution treatment in step (1) at a certain temperature for a period of time, and it is also referred to as "reageing treatment". In this invention, pre-deformation can include extrusion, drawing, rolling, solid solution and reageing treatment, etc.

Skilled artisans are able to choose specific pre-deformation and corresponding process parameters, depending on different magnesium alloy systems. In general, after magnesium alloys are subjected to extrusion, drawing or rolling at 350~460, twin crystals can form, slip systems of magnesium alloys can be increased and grain refinement can be achieved. For some magnesium alloy systems, a large number of twin crystal grains can form by means of solid solution and reageing treatment, and meanwhile some alloy phases can precipitate. The homogeneously precipitated alloy phases can improve the performance of the magnesium alloys. The inventors have found that only when the grain size of the magnesium alloys is fined to below 100 μm, can the magnesium alloys be subjected to subsequent continuous ECAP, no matter which pre-deformation is selected. The magnesium alloy preforms after pre-deformation can have a side-length or a diameter of 6~30 mm. The preforms are easy to break when they are too thin, but the power of the required equipment is large when they are too thick.

Figure 1B:
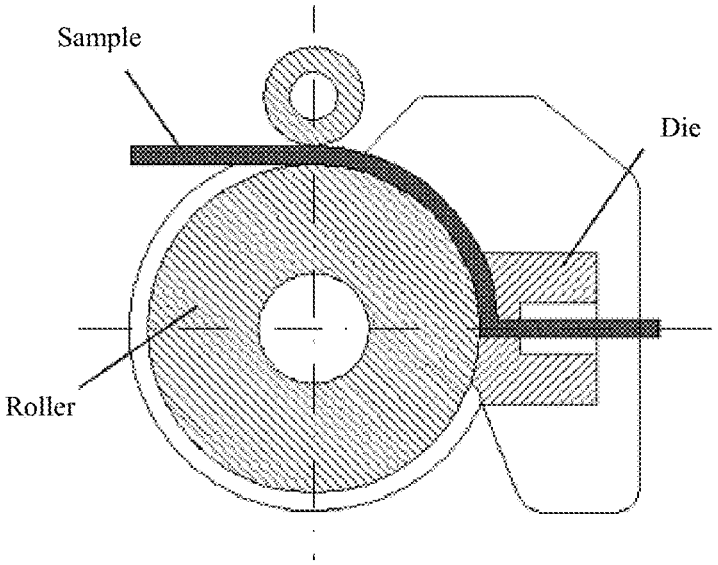
FIG. 1B is a schematic view showing the principle of continuous ECAP technique.

The magnesium alloys obtained from step (2) are subjected to continuous ECAP below their re-crystallization temperature. Grain refinement can be achieved by subjecting materials to severe plastic deformation when passing equal channels in traditional ECAP, whose principle is shown in FIG. 1A. In FIG. 1A, ECAP is performed in a die comprising two intersected channels, and when the two channels intersect in the die, an internal angle φ and an external angle ψ are formed. A sample passes through the channels under the force of press, and even and pure shear deformation occurs at the corner of the channels. The continuous ECAP is developed by improving traditional ECAP and subjects materials continuously to severe plastic deformation at high speed. The principle of continuous ECAP is illustrated schematically in FIG. 1B, in which a two-roller device replaces a plunger in the traditional ECAP and is used to provide a sample with the required force for severe plastic deformation. FIG. 1B only illustrates the principle of continuous ECAP, and other drive device which can replace the plunger in traditional ECAP to achieve continuous pressing can also be used in this invention. In other words, continuous ECAP either in the prior art or newly-developed after the filing date of the present application is applicable to this invention.

In the process of this invention, continuous ECAP is performed below the re-crystallization temperature, wherein the channel angle can be 90°~120°, the linear pressing speed can be not beyond 10 mm/s, and the strain rate in the last pass can be about 60~340%. The strain rate of the preform in the last pass can be divided into two parts. One is the strain generated during the roller rotation. The other is the strain generated when baffles change directions. If dies need be replaced so as to finally obtain the desired profile, the strain rate in the last pass includes the third part, which refers to the strain generated when preforms pass subsequent dies (so as to directly change into profiles). The second part of the strain can be calculated according to the following formula:

$$\varepsilon = \frac{2\cot(\varphi/2+\psi/2)+\psi\operatorname{cosec}(\varphi/2+\psi/2)}{\sqrt{3}}$$

$\varphi$—Internal angle $\psi$—External angle

Through repeated research, the inventors determine that the press speed cannot be too fast in the present invention, or magnesium alloy materials may incur brittle fracture. It is better that the press speed does not exceed 10 mm/s.

On the other hand, the accomplishment of continuous ECAP process requires the materials to be processed have a certain plasticity. The plasticity of the preforms can be improved by raising the pressing temperatures. But for the magnesium crystals, their grains would grow up as the temperature rises, and the growth of magnesium alloy grains tends to become quick over 350. And the plasticity of magnesium alloys below 350 usually cannot satisfy the technical requirements of the continuous ECAP. The magnesium alloys can be subjected to continuous ECAP below their re-crystallization temperature, i.e., at 200~350° C. after being pre-deformed in the present invention.

The strain rate of the last pass in the traditional ECAP is generally not more than 116%. But the strain rate of the last pass can reach 340% by utilizing continuous ECAP and replacing dies in the present invention. Strain rate is one of the main influential factors in grain refinement by plastic deformation. Grain refinement mechanism is mainly nucleation and growth mechanism of discontinuous dynamic recrystallization, when the strain rate is relatively small. In the present invention, the strain rate in the last pass is preferably not less than 60%. Grain refinement mechanism is dynamic recovery mechanism of sub-grains with high dislocation density, when the strain rate is sufficiently high. The original grain boundaries bent into zigzag shape because of severe plastic deformation. And sub-grains with large mis-orientation appear nearby grain boundaries. The sub-grains tilt as the grain boundaries migrate, and the strain-induced dislocation sub-grain boundaries transform into grain boundaries by dynamic recovery. Therefore, the grain refinement mechanisms are different between continuous ECAP and traditional ECAP due to different process characteristics therebetween.

In the present invention, the large strain rate reaching 340% can not only reduce the pass number of pressing so as to reduce cost, but also obtain ultra-fine grained magnesium alloys with the grain size of 100~450 nm, and even 100~200 nm. The grain size of the magnesium alloys prepared by traditional ECAP is only 500 nm-2 μm.

Therefore, continuous ECAP can be performed in a single pass or in multiple passes (e.g. in a few passes) in the present invention, so as to achieve good grain refinement. When continuous ECAP is performed in a single pass, the strain rate in the last pass can also be referred to as "strain rate of single pass". In order to obtain better grain refinement and uniformity, the preform is rotated 90° or 180° after one pass completes and before the next pass starts during multi-pass pressing. With the increase of pressing passes, the temperature gradient would fall in the continuous ECAP, thereby obtaining materials of higher properties.

In the present invention, the dies of different shapes can be used for ECAP of preforms of different shapes. Therefore, the preforms processed in step (2) can have a square or round cross section, without straightening and surface treatment. Profiles of various shapes, such as tubes, plates, bars, wire, strip, hollow profiles and other complex profiles, etc., can be processed by replacing the die in the last pass. The magnesium alloy profiles can be prepared by replacing the die in the last pass, thereby avoiding secondary processing and reducing costs. The inventors have designed different dies for continuous ECAP according to the ratios between fed and discharged materials, thereby achieving continuous production of magnesium alloy profiles of different sections (such as plate, tube, bar, etc.), avoiding grain growth of magnesium alloy profiles in secondary processing and ensuring the performances of the materials.

Finally, the magnesium alloy profiles obtained from step (3) are annealed at 150~300° C., so as to release residual stress in the profiles and decrease defects such as dislocation and twinning caused by continuous pressing. And after annealing, the plasticity of magnesium alloys can be improved, while the strength slightly decreases. In the present invention, to prevent grain growth, the temperature of annealing should not be too high and generally is below 300° C., and the time of annealing should not be too long and generally is less than 2 hrs. The specific temperature of annealing can be regulated depending on the magnesium alloy systems, and the specific time of annealing can be adjusted depending on the size of the magnesium alloy profiles. The tensile strength of the finally obtained magnesium alloy profiles can reach 300~400 MPa, and the elongation can be 20~35%.

The present invention also provides ultrafine-grained profiles of twin-crystal wrought magnesium alloys, which are prepared according to the process of the present invention. The ultrafine-grained profiles of magnesium alloys of the present invention have the following features:

(1) The profiles can have a size of more than 10 m, and be continuously produced. Hydraulic systems are used in traditional ECAP, and thus plungers are used to transmit axial force on the end face of the materials. Due to the factors such as the effective movement of hydraulic equipment, the stability of the plunger, force direction and friction resistance, the length of the prepared materials is generally less than 100 mm, and the materials have different deformation at different positions in the radical direction. In the present invention, continuous ECAP uses roll wheel as transmission mode and friction as driving force, and thus the deformation directions of materials are even, there is no limit to the movement, and profiles of thousands of meters in length can be prepared. The length of the ultrafine-grained profiles of magnesium alloys after continuous ECAP depends on the length of the fed materials.

(2) The grain sizes of the ultrafine-grained magnesium alloys in the profiles can be from 100 to 450 nm, even 100 to 200 nm, whereas the grain sizes of the magnesium alloys prepared by traditional ECAP are only 500 nm to 2 μm.

(3) The profiles can possess different cross sections, such as bars, plates, wires, tubes, strips, hollow profiles and so on. All the magnesium alloy profiles of different cross sections can be continuously produced.

(4) The tensile strength of the profiles can reach 300~400 MPa, and the elongation can reach 20~35%, wherein the two parameters can be determined by means of the conventional measurement methods in the art.

The present invention also provides use of the ultrafine-grained profiles of twin-crystal wrought magnesium alloys in making the medical treatment apparatus of types I, II and III, such as biodegradable cardiovascular stents and stents for neighbouring areas, vascular clamp, anastomat, sutures, bone plate and bone nail, implanted devices for surgical repairing, tissue engineering scaffolds and so on.

EXAMPLES

Below the present invention will be detailedly illustrated with reference to the examples. The average grain sizes of magnesium alloys in the examples were measured using Transmission Electronic Microscope (TEM).

Example 1

Preparation of Mg—Sn—Mn Alloy Bar (1) Mg-3Sn-0.5Mn alloy was prepared, wherein Sn was 3 weight-percent, Mn was 0.5 weight-percent, and the rest was Mg and unavoidable impurities. The prepared alloy materials were placed into a crucible of a melting furnace, wherein the materials were smelted under inert gas ($SF_6$+$CO_2$) protection. Once the materials were completely melted, they were cast at 720° C. into a cylindrical ingot with a diameter of 40 mm. After that, the ingot was subjected to solid solution treatment at 350° C. for 30 hrs.

(2) The ingot of Φ40 mm after solid solution was put into an extrusion cylinder of the same diameter in an extruder, wherein it was shaped into a cylindrical bar of Φ10 mm at 340 and with an extrusion speed of 40 mm/s and an extrusion ratio of 16:1. The obtained cylindrical bar had a great amount of twin crystals and the grain size of not larger than 100 μm.

(3) The preform obtained from step (2) was subjected to continuous ECAP of 4 passes at 300, wherein the linear press speed was kept at 6 mm/s, and the die was a continuous ECAP die with a round cross section and a channel angle of 120°. During the pressing, after one pass of ECAP was completed, the pressed bar was rotated 90° around the central axis as the rotation axis along the same direction before it was placed into the die again for the pressing of the next pass. The strain rate in the last pass was 150%.

(4) The bar was annealed at 200 for 1 hr.

Figure 2:
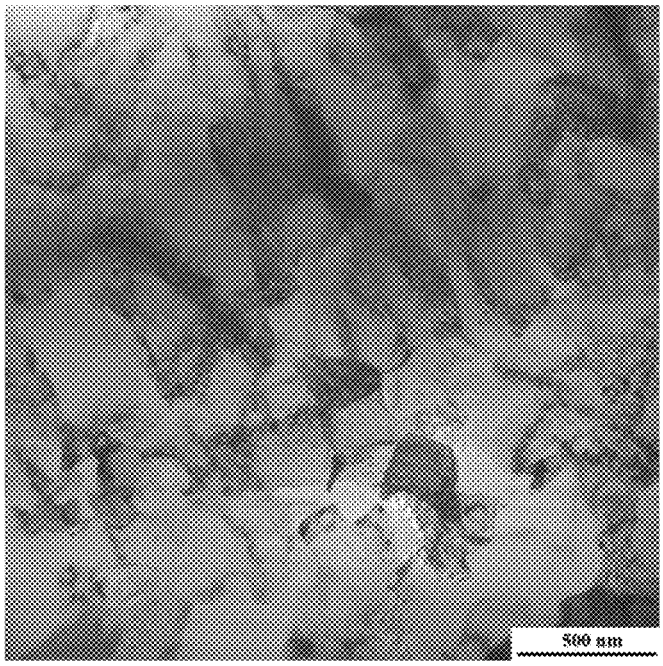
FIG. 2 is a TEM image of Mg-3Sn-0.5Mn alloy bar of Example 1.
Figure 3:
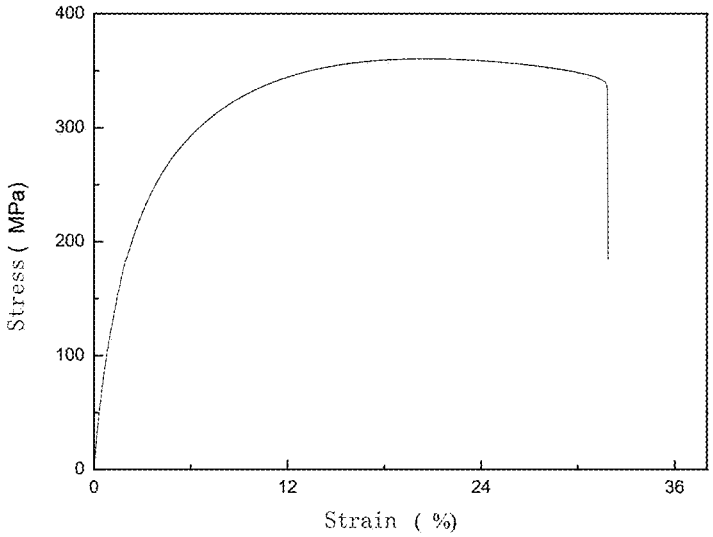
FIG. 3 shows a tensile curve of Mg-3Sn-0.5Mn alloy bar of Example 1.

The Mg-3Sn-0.5Mn alloy bar prepared as above had the average grain size of about 400 nm as shown in FIG. 2. Compared with the cast state, the tensile strength increased from 150 MPa to 360 MPa, and the elongation increased from 15% to 32%, as shown in FIG. 3. The Mg-3Sn-0.5Mn alloy bar can be used to manufacture biodegradable bone nail.

Example 2

Preparation of Mg—Zn—Zr Alloy Tube (1) Mg-5.5Zn-0.45Zr alloy was prepared, wherein Zn was 5.5 weight-percent, Zr was 0.45 weight-percent, and the rest was Mg and unavoidable impurities. The prepared alloy materials were placed into a crucible of a melting furnace, wherein the materials were smelted under inert gas ($SF_6$+$CO_2$) protection. Once the materials were completely melted, they were cast at 720° C. into a cylindrical ingot with a diameter of 20 mm. After that, the ingot was subjected to solid solution treatment at 300° C. for 25 hrs.

(2) The ingot of Φ20 mm after solution treatment was put into an extrusion cylinder of the same diameter in an extruder, wherein it was shaped into a cylindrical bar of Φ6.3 mm at 400° C. and with an extrusion speed of 30 mm/s and an extrusion ratio of 10:1. The obtained cylindrical bar had a great amount of twin crystals and the grain size of not larger than 100 μm.

(3) The preform obtained from step (2) was subjected to continuous ECAP of 6 passes at 300, wherein the linear press speed was kept at 2 mm/s, and the die was a continuous ECAP die with a round cross section and a channel angle of 120°. During the pressing, after one pass of ECAP was completed, the pressed bar was rotated 90° around the central axis as the rotation axis along the same direction before it was placed into the die again for the pressing of the next pass. The die was replaced with a tube die in the last pass. The strain rate in the last pass reached 340%.

(4) The tube after being pressed was annealed at 250 for 1 hr.

The Mg-5.5Zn-0.45Zr alloy tube prepared as above had the average grain size of about 150 nm, the tensile strength of 350 MPa and the elongation of 28%. The Mg-5.5Zn-0.45Zr alloy tube can be used to manufacture biodegradable intravascular stent and stents for neighboring areas.

Example 3

Preparation of Mg—Sn—Zn—Mn Alloy Wire (1) Mg-3Sn-1Zn-0.5Mn alloy was prepared, wherein Sn was 3.0 weight-percent, Zn was 1.0 weight-percent, Mn was 0.5 weight-percent, and the rest was Mg and unavoidable impurities. The prepared alloy materials were placed into a crucible of a melting furnace, wherein the materials were smelted under inert gas ($SF_6$+$CO_2$) protection. Once the materials were completely melted, they were cast at 720° C. into a cylindrical ingot with a diameter of 30 mm. After that, the ingot was subjected to solid solution treatment at 350° C. for 20 hrs.

(2) The ingot of Φ30 mm after solid solution was put onto a drawing machine, wherein it was shaped into a cylindrical bar of Φ7 mm at 400 and with a draw speed of 35 mm/s. The obtained cylindrical bar had a great amount of twin crystals and the grain size of not larger than 100 μm.

(3) The preform obtained from step (2) was subjected to continuous ECAP of 6 passes at 330, wherein the linear press speed was kept at 6 mm/s, and the die was a continuous ECAP die with a round cross section and a channel angle of 100°. During the pressing, after one pass of ECAP was completed, the pressed bar was rotated 180° around the central axis as the rotation axis along the same direction before it was placed into the die again for the pressing of the next pass. The die was replaced with a wire die in the last pass. The strain rate in the last pass reached 300%.

(4) The wire after being pressed was annealed at 150 for 0.5 hrs.

The Mg-3Sn-1Zn-0.5Mn alloy wire prepared as above had the average grain size of about 200 nm, the tensile strength of 360 MPa and the elongation of 25%. The Mg-3Sn-1Zn-0.5Mn alloy wire can be used to manufacture biodegradable intravascular stent and degradable sutures.

Example 4

Preparation of Mg—Al—Mn Alloy Plate (1) AM60 alloy was prepared, wherein Al was 6.4 weight-percent, Mn was 0.4 weight-percent, Zn was 0.2 weight-percent, and the rest was Mg and unavoidable impurities. The prepared alloy materials were placed into a crucible of a melting furnace, wherein the materials were smelted under inert gas ($SF_6$+$CO_2$) protection. Once the materials were completely melted, they were cast at 720° C. into a cuboidal ingot with a thickness of 40 mm. After that, the ingot was subjected to solid solution treatment at 400° C. for 20 hrs.

(2) The ingot after solid solution was rolled into a 10 mm thick plate by a rolling mill and then cut into a 10 mm wide square bar. The obtained bar had a great amount of twin crystals and the grain size of not larger than 100 μm.

(3) The preform obtained from step (2) was subjected to continuous ECAP of 4 passes at 280, wherein the linear press speed was kept at 3 mm/s, and the die was a continuous ECAP die with a round cross section and a channel angle of 90°. During the pressing, after one pass of ECAP was completed, the pressed bar was rotated 180° around the central axis as the rotation axis along the same direction before it was placed into the die again for the pressing of the next pass. The strain rate in the last pass reached 225%.

(4) The plate after being pressed was annealed at 280 for 2 hrs.

The AM60 alloy plate prepared as above had the average grain size of about 300 nm, the tensile strength of 320 MPa and the elongation of 28%. The AM60 alloy plate can be used to manufacture biodegradable internal fixation bone plate.

Example 5

Preparation of Mg—Al—Zn Alloy Hollow Profile (1) AZ31 alloy was prepared, wherein Al was 3.0 weight-percent, Zn was 1.0 weight-percent, Mn was 0.3 weight-percent, and the rest was Mg and unavoidable impurities. The prepared alloy materials were placed into a crucible of a melting furnace, wherein the materials were smelted under inert gas ($SF_6$+$CO_2$) protection. Once the materials were completely melted, they were cast at 720° C. into a cylindrical ingot with a diameter of 30 mm. After that, the ingot was subjected to solid solution treatment at 400° C. for 22 hrs.

(2) The ingot after solid solution was re-aged at 200 for 5 times, and every reageing treatment lasted for 2 hrs. The obtained round bar had a great amount of transformation twin crystals.

(3) The preform obtained from step (2) was subjected to continuous ECAP of 4 passes at 300, wherein the linear press speed was kept at 4 mm/s, and the die was a continuous ECAP die with a round cross section and a channel angle of 90°. During the pressing, after one pass of ECAP was completed, the pressed bar was rotated 90° around the central axis as the rotation axis along the same direction before it was placed into the die again for the pressing of the next pass. The die was replaced with a hollow profile die in the last pass. The strain rate in the last pass reached 320%.

(4) The hollow profile after being pressed was annealed at 240 for 1 hr.

The AZ31 alloy hollow profile prepared as above had the average grain size of about 350 nm, the tensile strength of 355 MPa and the elongation of 30%. The AZ31 alloy plate can be used to manufacture tissue engineering scaffolds, such as anastomosis ring.

Example 6

Preparation of Mg-RE-Zr Alloy Bar (1) Mg-4Y-3.3Nd-0.5Zr alloy was prepared, wherein Y was 4.0 weight-percent, Nd was 3.3 weight-percent, Zr was 0.5 weight-percent, and the rest was Mg and unavoidable impurities. The prepared alloy materials were placed into a crucible of a melting furnace, wherein the materials were smelted under inert gas ($SF_6$+$CO_2$) protection. Once the materials were completely melted, they were cast at 720° C. into a cylindrical ingot with a diameter of 40 mm. After that, the ingot was subjected to solid solution treatment at 350° C. for 24 hrs.

(2) The ingot of Φ40 mm after solid solution was put into an extrusion cylinder of the same diameter in an extruder, wherein it was shaped into a cylindrical bar of Φ10 mm at 340 and with an extrusion speed of 40 mm/s and an extrusion ratio of 16:1. The obtained cylindrical bar had a great amount of twin crystals and the grain size of not larger than 100 μm.

(3) The preform obtained from step (2) was subjected to continuous ECAP of a single pass at 300, wherein the linear press speed was kept at 1 mm/s, and the die was a continuous ECAP die with a round cross section and a channel angle of 90°. The strain rate in the single pass reached 225%.

(4) The bar after being pressed was annealed at 200 for 1 hr.

The Mg-4Y-3.3Nd-0.5Zr alloy bar prepared as above had the average grain size of about 450 nm. Compared with the cast state, the tensile strength increased from 160 MPa to 300 MPa, and the elongation increased from 14% to 30%. The Mg-4Y-3.3Nd-0.5Zr alloy bar can be used to manufacture biodegradable bone nail.

What is claimed is:

1. A process for preparing ultrafine-grained profile of twin-crystal wrought magnesium alloys, which comprises the steps as follows:

(1) subjecting raw materials of magnesium alloys to smelting and casting under atmospheric protection, and solid solution at 300~500° C.;

(2) subjecting a preform obtained from step (1) to pre-deformation, so that beyond 30% by volume of twin crystal microstructure forms in the magnesium alloys and a grain size of not larger than 100 μm is achieved;

(3) conducting continuous Equal Channel Angular Pressing process of the magnesium alloys obtained from step (2) at the re-crystallization temperature, wherein the channel angle is 90°~120°, the linear pressing speed is not beyond 10 mm/s, the strain rate in the last pass is about 60~340%; and (4) annealing the profile at 150~300° C.

2. A process according to claim 1, wherein the magnesium alloys are alloys selected from the group consisting of Mg-RE, Mg—Th, Mg—Li, Mg-RE-Zr, Mg—Al—Mn, Mg—Al—Zn, Mg—Zn—Zr, Mg—Sn—Mn and Mg—Sn—Zn—Mn.

3. A process according to claim 2, wherein the RE of Mg-RE alloy is one or several of Nd, Y, Gd and totally 3.0~9.0 weight-percent in content, and the rest is Mg and unavoidable impurities;

the content of Th in Mg—Th alloy is 0.10~4.0 weight-percent, and the rest is Mg and unavoidable impurities;

the content of Li in Mg—Li alloy is 0.10~5.0 weight-percent, and the rest is Mg and unavoidable impurities;

RE in Mg-RE-Zr alloy is one or several of Nd, Y, Gd and totally 3.0~9.0 weight-percent in content, the content of Zr is 0.2~3.5 weight-percent, and the rest is Mg and unavoidable impurities;

the content of Al in Mg—Al—Mn alloy is 1.0~6.5 weight-percent, the content of Mn is 0.10·1.0 weight-percent, the content of Zn is 0.10~0.40 weight-percent, and the rest is Mg and unavoidable impurities;

the content of Al in Mg—Al—Zn alloy is 1.0~6.5 weight-percent, the content of Zn is 0.10~6.5 weight-percent, the content of Mn is 0.10~1.0 weight-percent, and the rest is Mg and unavoidable impurities;

the content of Zn in Mg—Zn—Zr alloy is 0.1~6.5 weight-percent, the content of Zr is 0.20~3.5 weight-percent and the rest is Mg and unavoidable impurities;

the content of Sn in Mg—Sn—Mn alloy is 1.0~10 weight-percent, the content of Mn is 0.10~1.0 weight percent and the rest is Mg and unavoidable impurities;

the content of Sn in Mg—Sn—Zn—Mn alloy is 1.0~10 weight-percent, the content of Zn is 0.50~10 weight-percent, the content of Mn is 0.10~1.0 weight-percent and the rest is Mg and unavoidable impurities.

4. A process according to claim 1, wherein the pre-deformation in step (2) includes extrusion, drawing, rolling, or solid solution and reageing treatment, and magnesium alloys after pre-deformation are not subjected to straightening and surface treatment.

5. A process according to claim 1, wherein the continuous Equal Channel Angular Pressing process in step (3) is performed in multi-passes, and the magnesium alloy preform is rotated 90° or 180° after one pass completes and before the next pass starts.

6. A process according to claim 1, wherein the profile obtained in step (3) is selected from the group consisting of tubes, plates, bars, wire, strip, and hollow profiles.

7. A process according to claim 1, wherein the grain sizes of the finally-obtained magnesium alloy profiles are from 100 to 450 nm.

8. A process according to claim 1, wherein the finally-obtained magnesium alloy profiles have a tensile strength of 300~400 MPa and an elongation of 20~35%.

9. A process according to claim 1, wherein die is replaced in the last pass of the pressing according to the profile.

10. A process according to claim 1, wherein the grain sizes of the finally-obtained magnesium alloy profiles are from 100 to 200 nm.

* * * * *